United States Patent [19]

Dahm

[11] Patent Number: 4,627,454

[45] Date of Patent: Dec. 9, 1986

[54] COSMETIC STICK WITH APPLICATOR

[76] Inventor: Klaus-Peter Dahm, Stettiner Strasse 25A, 3011 Rethen/Leine, Fed. Rep. of Germany

[21] Appl. No.: 498,956

[22] Filed: May 27, 1983

Related U.S. Application Data

[63] Continuation of Ser. No. 965,657, Dec. 1, 1978, abandoned, which is a continuation of Ser. No. 644,186, Dec. 24, 1975, abandoned, which is a continuation-in-part of Ser. No. 539,735, Jan. 9, 1975, abandoned.

[51] Int. Cl.[4] ..... A45D 40/26

[52] U.S. Cl. ..... 132/88.7; 401/126

[58] Field of Search ..... 132/88.7, 88.5, 79 R, 132/31.2, 32.3; 401/126, 129; 604/1-2

[56] References Cited

U.S. PATENT DOCUMENTS

| | | | |
|---|---|---|---|
| 1,962,875 | 6/1934 | Reber | 401/130 X |
| 3,146,806 | 9/1964 | Ginsburg | 401/126 X |
| 3,228,398 | 1/1966 | Leonard et al. | 604/1 |
| 3,262,461 | 7/1966 | Kambersky | 401/129 X |
| 3,372,424 | 3/1968 | Kellett | 15/257.05 |
| 3,471,244 | 10/1969 | Melocchi | 401/122 |
| 3,957,066 | 5/1976 | Dahm | 132/88.7 |

FOREIGN PATENT DOCUMENTS

| | | | |
|---|---|---|---|
| 2601078 | 7/1976 | Fed. Rep. of Germany | 401/122 |
| 556277 | 11/1974 | Switzerland | 401/122 |
| 1142564 | 2/1969 | United Kingdom | 401/122 |
| 1147846 | 4/1969 | United Kingdom | 401/122 |

*Primary Examiner*—Gregory E. McNeill
*Attorney, Agent, or Firm*—Collard, Roe & Galgano

[57] ABSTRACT

A cosmetic stick for applying a liquid preparation to the skin of the user with a container into the opening of which a wiping means is inserted which comprises several lips of different configuration super-imposed at different levels, the upper lips thereof encompassing a shaft member of the applicator carrying an applicator pad, the lower lips surrounding said applicator pad made of soft plastic foam and having a smaller diameter than the applicator shaft.

18 Claims, 3 Drawing Figures

COSMETIC STICK WITH APPLICATOR

Figure 2:
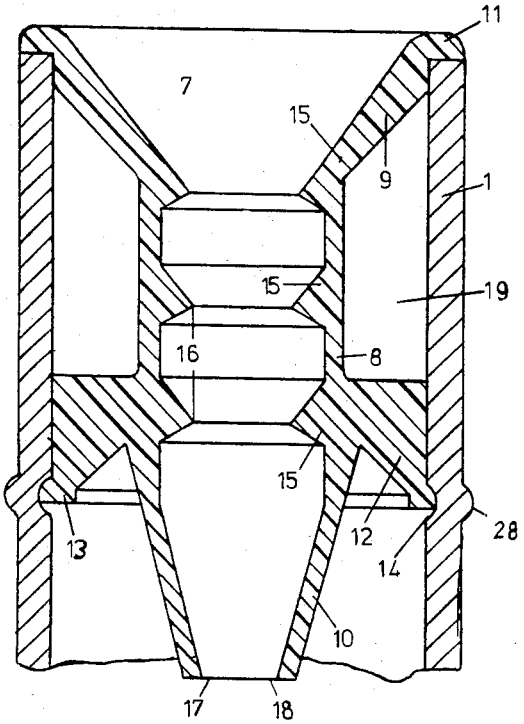

This application is a continuation of Appln. Ser. No. 965,657, filed 12/1/78, which in turn is a continuation of application Ser. No. 644,186, filed 12/24/75 which in turn is a continuation in part Appln. of Ser. No. 539,735, filed 1/9/75 now abandoned.

The present invention relates to a cosmetic stick with an applicator for applying a liquid, pastelike or powdery preparation from a cylindrical container to the user's skin. The invention is particularly suitable for the use as an eye shadow applicator for applying a liquid colourant to the eyelid.

It is the object of the present invention to provide a cosmetic stick in particular an eye shadow applicator such that it allows a quick, measured and clean application of a cosmetic preparation to the skin of the user.

Another object is to provide means which enable the application of the preparation in precisely controlled quantities in the absence of any drop formation and whereby a shaft carrying the applicator is protected against any deposits of the preparation when said applicator has been withdrawn from the container of the preparation. Preferably a wiping or stripper means for the applicator is fitted in the container opening.

The invention further provides a cosmetic stick the applicator of which is capable of leakproof storage of a liquid preparation sufficient for one application.

According to an important feature of the present invention the liquid or powdery preparation of the cosmetic stick is filled in a cylindrical container which is closed by a cap. This cap encloses a shaft member carrying an applicator pad, consisting of a piece of soft cellular plastic foam preferably of a polyether plastic foam which has open cells for receiving and storing a measured amount of the preparation.

An applicator pad made in one piece from such a soft, cellular plastic foam ensures, even over a longer period of time, a functional use of the applicator, conditioned by the fact that the plastic foam, because of its cellular structure and its chemical nature, does not cause a reaction with the colourant matter and has a negligibly small swelling property. Such a soft plastic foam also enables a gentle application of the colourant to the skin and makes the applicator pad capable for a leakproof storage in an amount of the colourant which is sufficient for one application. Suitably the applicator pad should have a length of preferably about 20 mm, an external diameter of about 6 mm and an internal diameter of about 2 mm. An applicator pad of such dimensions has a storing capacity for a colourant sufficient for one application. For the applicator also a hair pencil or a brush may be used.

The shaft member carrying the applicator pad is secured to the cap which closes the colourant container and has suitably a larger diameter than that of the applicator pad. Consequently the applicator pad, when saturated with the liquid colourant on withdrawing from the container does not touch the walls of the colourant container, and the colour is not allowed to accumulate and cannot soil the fingers of the user.

The upper end of the colourant container may be provided with a wiping device which allows a return flow of the wiped off surplus colourant from the applicator. That part which touches the applicator should consist of a flexible material. Such an arrangement avoids any undesirable leakage of colourant from the colourant container on withdrawal of the applicator.

Suitable as a colourant is a dispersion of an insoluble colour in a carrier liquid which is adaptable to the physical properties of the plastics foam of the pad.

The wiping means fitted in the container opening may have several resilient lips of different configuration superimposed at different levels, the upper lips encompassing the shaft member and the lower lips surrounding the pad of the applicator.

The novel design of the cosmetic stick provides separate wiping action on the shaft member and the pad of the applicator to thereby ensure a neat and drip-less application of the cosmetic preparation to the user's skin, because the upper portion of the wiper lips strips the applicator shaft member while the lower portion acts on the applicator pad to remove excessive dyestuff therefrom.

A particularly neat wiping result for the applicator is obtained according to a modification of this invention if a plurality of wiping lips superimposed at different levels are associated with the applicator shaft member and compressively encompass said shaft member and uniformly strip the entire circumference thereof as the applicator is withdrawn from the container. The bottom part of the wiping means associated with the pad is preferably tapered and provided with an opening whose diameter is smaller than that of the pad. The compressive force applied to the pad by the prestressed wiping lips depends on the degree of flexibility of said lips which will be selected so that as the pad is pulled from the container it undergoes partial compression and only picks up the amount of preparation just required for the respective application. In this way there is a precise dosage of the preparation to be applied to the user's skin ensured in addition to a neat application. The scraper portion acting on the pad may also be in the form of an inversed cone with an axially extending cut provided therein whose length determines the flexibility of the scraper lips.

The lower truncated cone portion of the scraper may be closed off by a bottom member in the form of a flat or slightly dished flexible disk with a plurality of radial cuts therein to form scraper lips. The resultant sector shaped scraper lips due to their flexibility act on the pad in such a way that the dye quantity conforming to the desired dosage only will be removed and all excessive product is stripped off as the applicator is pulled from the container.

Figure 1:
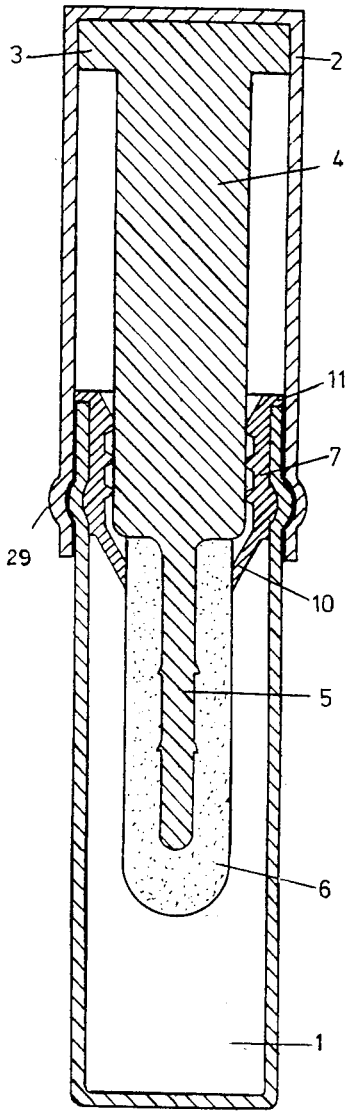
Figure 4:
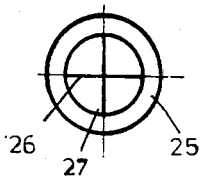
Figure 3:
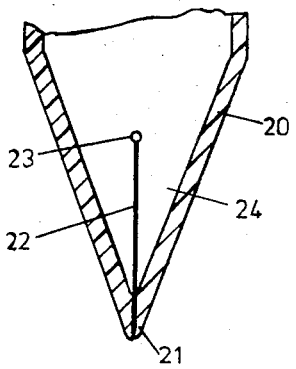

The present invention will be explained in detail with reference to the accompanying drawings in which by way of examples several embodiments of the invention are shown:

In the drawings FIG. 1 is a longitudinal section through a cosmetic stick with applicator for applying a liquid colourant, FIG. 2 is a larger scale longitudinal section through the wiping means, FIG. 3 is a longitudinal part section through another wiping embodiment, and FIG. 4 is a top view of a further embodiment of the wiping means.

As will be seen from FIG. 1 the cosmetic stick, for instance to apply eye shadow, comprises a rigid cylindrical container 1 which may be manufactured from transparent or coloured plastic. Said container 1 is fitted with a clip-on or screw-on type closing cap 2 in which a disk 3 with a cylindrical shaft member 4 is inserted.

The solid plain shaft 4 has an extension in the form of a stem member 5 that is provided with projections or lug portions for positive connection with a pad 5 slipped up on said stem 5. The pad 6 preferably consists of one piece of cylindrically shaped soft cellular plastic foam for instance polyether foam and has a smaller external diameter than the shaft member 4 so that said pad 6 does not touch the wall of the container 1 when the cap 2 is withdrawn from the container for application of the cosmetic preparation.

Inserted into the upper end of the container 1 and secured therein by an annular groove 14 is a wiper means 7 which is shown in about ten-fold enlargement in FIG. 2. The wiper means 7 comprises a central cylindrical portion 8 with a tapered upper endpiece 9 and a funnel-shaped lower endpiece 10. The upper endpiece 9 protrudes by a projecting edge 11 over the marginal edge of the container 1 to provide a seal against the closing cap 2. The bottom end of the central cylindrical portion 8 is retained in the annular groove 14 of the container 1 via a ring portion 12 having its marginal edges provided in the form of a bead 13 which engages the annular groove 14. The external face of the groove 14 comprises a bulb 28 which engages a bulb 29 of the cap 2 and retains the cap in the closed position as shown in FIG. 1.

Superimposed in the central cylindrical portion 8 of the wiper 7 are three wiper lips 15 whose cross-section is in the form of a triangle and whose inner marginal edge 16 is formed by a nearly rectangular tip. The diameter of said inner marginal edge 16 is smaller than the outer diameter of the plain cylindrical shaft member 4 which is hence compressively surrounded by said inner marginal edge 16 of said wiper lips 15 with the inner edge 16 being in full and sealing contact with the shaft member 4. The cross-sectional configuration of the inner marginal edge 16 may also be that of an acute or obtuse angle's vertex.

The funnel-shaped lower endpiece 10 of the wiper 7 has an opening 17 whose diameter is smaller than the diameter of the pad 6 so that the inner marginal edge 18 thereof is radially forced against the circumference of the pad 6 owing to the flexibility of said endpiece 10.

To apply the dye preparation or the like contained in said container 1 to a user's skin, the closing cap 2 with applicator 4, 5, 6 is withdrawn from the container with the inner marginal edge 16 of the wiper lips 15 uniformly wiping along the entire circumference of the shaft member 4 to strip therefrom any adhering preparation completely without leaving any trace of it on said member.

Independently of this action the pad 6 becomes uniformly compressed by the inner marginal edge 18 of the flexible endpiece 10, the degree of said compression and/or of the pressure applied being a function of the flexibility of said scraper endpiece 10. This flexibility will be selected so that on coming clear of the inner marginal edge 18 the pad 6 will only carry the very amoung of dye substance that will just be required for one use of the cosmetic stick. Accordingly there is no excessive product left over after such use that might soil the user's fingers or clothing. In consequence, said separate scraping of shaft member 4 and pad 6 of the applicator as made possible according to the present invention is of particular importance to the usability of the cosmetic stick because such a drip-less application of liquid or paste-like dye or other e.g. powder preparations of cosmetic nature in precisely dosed quantities has not been practicable with any of the cosmetic implements so far prior known in the art.

The wiper 7 shown in FIG. 2 is preferably made from plastic such as polyethylene or the like and has in its outer shell a recess 19 which increases the flexibility of the cylindrical central portion 8 on which the scraper lips 15 are disposed. For wipers 7 made from rubber or the like this annular recess 19 may be omitted and the wiper 7 has the configuration of a cylinder in contact with the inside wall surface of the container 1 throughout its entire length.

As can be seen from FIG. 3 the lower endpiece of the wiper 7 may also comprise an inversed cone of taper 20 having an axial cut 22 extending from the tip 21 provided therein which at its upper end terminates in a circular hole 23 and which splits the endpiece 20 into two half-taper type scraper lips 24. The axial length of said cut 22 ending in said hole 23 will be such as to provide the two half-taper type scraper lips 24 with an elasticity and flexibility sufficient to ensure that the pad 6 immersed in the liquid stored in the container 1 only picks up a precisely predetermined quantity of the preparation as the cap 2 with the applicator is pulled from said container 1 and that the excessive product flows back into the container 1.

After the cap 2 with the applicator has been removed from the container 1, the tip 21 of the tapered endpiece 20 is closed owing to the flexibility thereof which additionally offers the particular advantage that after such removal of the applicator said container 1 is sealed so as to prevent any dye substance or the like from draining out as the container 1 is tilted upside down. This feature essentially improves the usability of the cosmetic stick.

In the embodiment according to FIG. 4 the opening 17 of the tapered endpiece 10 of FIG. 2 is closed off by means of a flexible, slightly dished disk member 25 through the circular central portion of which extend two diametral and crosswise intersecting cuts 26. This arrangement provides four sector shaped scraper lips 27 which are in a forced contact with the pad 6 under a pressure that conforms to the flexibility of the scraper lips 27 and the length of the cuts 26.

Due to this inwardly directed radial pressure the pad 6 will be compressed so that it picks up and stores only the very amount of preparation that will be needed for just one application.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A one-piece, integrally and simultaneously formed hollow wiper member for use in connection with an applicator assembly which includes a container having an open end and an applicator having an elongated shaft and an application member secured to one end of said shaft which is insertable into said one end of said container so as to remove a liquid or powdery preparation contained therein, comprising:

a hollow wiper housing having an internal surface defining an internal channel and at least two annular, asymmetrical, resilient, radially-deformable first wiper lips disposed successively in said channel of said wiper housing adjacent to said open end of said container and directed radially-inwardly from said surface of said wiper housing, each of said first wiper lips having a generally triangular cross section and having a radially inwardly and downwardly sloping upper surface and a radially inwardly and upwardly sloping lower surface converging into a wiping edge at an angle of about at least 90°, said upper surface being longer than said lower surface, said edge having a diameter which is less than the diameter of said application shaft;

at least one second wiper lip disposed beneath and spaced apart from said first wiper lips in said housing, said second wiper lip having a smaller diameter than the application member so that when the applicator shaft and the member are withdrawn from said container, said second wiper lip makes wiping contact with the application member to portion the amount of liquid or powder removed from said container, and said first wiper lips become radially deformed and make wiping contact with said applicator shaft so as to completely clean and remove the powder or liquid adhering to the surface of said applicator shaft.

2. The wiper member according to claim 1, wherein the included angle between said upper and lower surfaces is 90°.

3. The wiper member according to claim 1, wherein the included angle between said upper and lower surfaces of said first wiper lip is an obtuse angle.

4. The wiper member according to claim 1, wherein said wiper member has an upper end portion and a lower end portion, each of which has a generally hollow conical configuration and wherein said lower end portion forms said second wiper lip and tapers downwardly to a tip, said lower end portion having an axial slip formed therein which subdivides said lower end portion into two semiconically-shaped wiper lips which are disposed to enclose and make wiping contact with said application member of said applicator.

5. The wiper member according to claim 1, wherein said application member has a generally cylindrical configuration and wherein said wiper member has a lower hollow downwardly-tapered, frustoconical end portion forming said second wiper lip, the outer open end of which has a diameter which is smaller than the outer diameter of the application member of said applicator.

6. The wiper member according to claim 5, including a resilient disc mounted on said wiper device and closing said outer open end of said lower end portion, said disc having at least one diametrical slit formed therein to form a plurality of sector-shaped wiper lips.

7. The wiper member according to claim 1, wherein said hollow wiper member has a generally cylindrical outer surface which engages the inner wall of said container adjacent to said open end thereof.

8. The wiper member according to claim 7, wherein said outer cylindrical surface of said hollow wiper member has a circumferentially-extending annular recess formed therein which serves to promote the flexibility of said wiper lips by providing a more resilient support therefor.

9. An applicator device for applying to a surface a liquid or powdery substance from a container having an open end, comprising:

an applicator having an elongated shaft and an application member secured to one end of said shaft which is insertable into said open end of said container so as to remove a liquid or powdery preparation contained therein;

a one-piece, integrally and simultaneously formed hollow wiper housing mounted within said container adjacent to said open end thereof and having an internal surface defining a generally cylindrical internal channel and at least two resilient, annular, asymmetrical, radially deformable, first wiper lips which are successively disposed in said channel of said wiper housing adjacent to said open end of said container and which are directed radially-inwardly from said internal surface of said wiper housing, each of said first wiper lips having a generally triangular cross section and having, relative to said channel and said open end of said container, respectively, a radially-inwardly and downwardly-sloping, upper surface and a radially-inwardly and upwardly-sloping lower surface converging into a wiping edge at an angle of about at least 90°, said upper surface being longer than said lower surface and said edge having a diameter which is less than the diameter of said application shaft; and at least one second wiper lip disposed beneath and spaced apart from said first wiper lips in said housing, said second wiper lip having a smaller diameter than the application member so that when the applicator shaft and the member are withdrawn from said container, said second wiper lip makes wiping contact with the application member to portion the amount of liquid or powder removed from said container, and said first wiper lips become radially deformed and make wiping contact with said applicator shaft so as to completely clean and remove the powder or liquid adhering to the surface of said applicator shaft.

10. The applicator device according to claim 9, wherein the included angle between said upper and lower surfaces is 90°.

11. The applicator device according to claim 9, wherein the included angle between said upper and lower surfaces of said first wiper lip is an obtuse angle.

12. The applicator device according to claim 9, wherein said wiper member has an upper end portion and a lower end portion each of which has a generally hollow conical configuration and wherein said lower end portion tapers downwardly to a tip, said lower end portion forms said second wiper lip and having an axial slit formed therein which subdivides said lower end portion into two semiconically-shaped wiper lips which are disposed to enclose and make wiping contact with said application member of said applicator.

13. The applicator device according to claim 9, wherein said application member has a generally cylindrical configuration and wherein said wiper member has a lower hollow downwardly-tapered, frustoconical end portion forming said second wiper lip, the outer open end of which has a diameter which is smaller than the outer diameter of the application member of said applicator.

14. The applicator device according to claim 13, including a resilient disc mounted on said wiper device and closing said outer open end of said lower end portion, said disc having at least one diametrical slit formed therein to form a plurality of sector-shaped wiper lips.

15. The applicator device according to claim 9, wherein said hollow wiper member has a generally cylindrical outer surface which engages the inner wall of said container adjacent to said open end thereof.

16. The applicator device according to claim 15, wherein said outer cylindrical surface of said hollow wiper member has a circumferentially-extending annular recess formed therein which serves to promote the flexibility of said wiper lips by providing a more resilient support therefor.

17. An applicator device for applying to a surface a liquid or powdery substance from a container having an open end, comprising:

an applicator having an elongated shaft and an application member secured to one end of said shaft which is insertable into said open end of said container so as to remove a liquid or powdery preparation contained therein;

a one-piece hollow wiper housing mounted within said container adjacent to said open end thereof and having an upper end portion and a lower end portion joined together by an intermediate portion, said upper end portion and said lower end portion each having a generally downwardly-tapering, funnel-shaped configuration and said intermediate portion having an internal surface defining a generally cylindrical internal channel, and at least two resilient, annular, first wiper lips integrally joined thereto which are successively disposed in said channel thereof and which are directed radially-inwardly from said internal surface of said wiper housing, each of said first wiper lips having a generally triangular cross section and having a radially-inwardly and downwardly-sloping, upper surface and a radially-inwardly and upwardly-sloping lower surface converging into a wiping edge at an angle of about at least 90°, said upper surface being longer than said lower surface and said edge having a diameter which is less than the diameter of said application shaft; and at least one second wiper lip, integrally connected to said lower end portion of said housing, disposed beneath and spaced apart from said first wiper lip in said housing, said second wiper lip having a smaller diameter than the application member so that when the applicator shaft and the member are withdrawn from said container, said second wiper lip makes wiping contact with the application member to portion the amount of liquid or powder removed from said container, and said first wiper lips make wiping contact with said applicator shaft so as to completely clean and remove the powder or liquid adhering to the surface of said applicator shaft.

18. A hollow wiper member for use in connection with an applicator assembly which includes a container having an open end and an applicator having an elongated shaft and an application member secured to one end of said shaft which is insertable into said one end of said container so as to remove a liquid or powdery preparation contained therein, comprising:

a hollow wiper housing having an internal surface defining an internal channel and a plurality of resilient first wiper lips disposed in said channel of said wiper housing adjacent to said open end of said container and directed radially-inwardly from said surface of said wiper housing, said first wiper lips having a generally triangular cross section and having upper and lower surfaces converging into a wiping edge, said edge having a diameter which is less than the diameter of said application shaft, said hollow wiper member having an outer cylindrical surface in which is formed a circumferentially-extending annular recess which serves to promote the flexibility of said wiper lips by providing a more resilient support therefor; and at least one second wiper lip disposed beneath and spaced-apart from said wiper lips in said housing, said second wiper lip having a smaller diameter than the application member so that when the applicator shaft and the member are withdrawn from said container, said second wiper lip makes wiping contact with the application member to portion the amount of liquid or powder removed from said container, and said plurality of first wiper lips makes wiping contact with said applicator shaft so as to completely clean and remove the powder or liquid adhering to the surface of said applicator shaft.

* * * * *